United States Patent [19]

Doerner et al.

[11] 4,070,862

[45] Jan. 31, 1978

[54] CASCADED TWO-FLUID ROTARY CLOSED RANKINE CYCLE ENGINE

[75] Inventors: William Allen Doerner; Oral R. Van Buskirk, both of Wilmington, Del.

[73] Assignee: E. I. Du Pont de Nemours and Company, Wilmington, Del.

[21] Appl. No.: 726,296

[22] Filed: Sept. 24, 1976

[51] Int. Cl.[2] ..... F01K 23/02; F01K 11/04

[52] U.S. Cl. ..... 60/655; 60/669

[58] Field of Search ..... 60/655, 669; 122/11

[56] References Cited

U.S. PATENT DOCUMENTS

| | | | |
|---|---|---|---|
| 1,961,786 | 6/1934 | Roe | 60/649 |
| 3,266,246 | 8/1966 | Heller | 60/655 |
| 3,613,368 | 10/1971 | Doerner | 60/669 |
| 3,769,796 | 11/1973 | Bechtold | 60/669 |

*Primary Examiner*—Allen M. Ostrager

[57] ABSTRACT

A cascaded, two-fluid, rotary Rankine cycle engine is provided having improved efficiency and being capable of operating with a power fluid which is solid at ambient temperature. The engine comprises a rotatable annular boiler containing a first boiler liquid and means to heat this first boiler liquid to generate pressure vapor in the boiler, an expander system for extracting work from the vapor, an annular condenser rotatable with the boiler for condensing the exhaust vapor from the expander, said condenser having heat exchange tubes over which the exhaust vapor is passed to heat a second liquid contained in the tubes to generate pressure vapor therein, the second liquid having a lower boiling point than the first liquid, means for returning the vapor condensate to the boiler, a second expander system for extracting work from the pressure vapor in the heat-exchanging tubes, a rotatable second condenser for condensing the exhaust vapor from the second expander, and means for returning the vapor condensate from the second condenser to the heat-exchange tubes.

23 Claims, 8 Drawing Figures

CASCADED TWO-FLUID ROTARY CLOSED RANKINE CYCLE ENGINE

This invention relates to new and useful improvements in rotary heat engines, and more particularly to closed Rankine cycle engines of the rotating type having novel means for cascading two power fluid cycles.

In comparison with other types of heat engines, Rankine cycle engines offer quietness and low pollution. Furthermore, rotary Rankine cycle engines offer simplicity and improved efficiency; but all portable size Rankine cycle engines suffer from low efficiency in comparison with other types of heat engines. Compounding or cascading two power cycles in a Rankine cycle engine offers a means of providing increased efficiency. However, such engines are exceedingly complex and expensive to build. Another problem with cascaded Rankine cycle engines is that candidate power fluids for the high-temperature cycle, which must have high thermal stability and a high-boiling point, are often solid at ambient temperature.

With the foregoing in mind, an object of the present invention is to provide a rotating, closed, Rankine cycle engine with improved engine efficiency as a result of cascading two fluid power cycles. Another object of the invention is to provide improved efficiency of a cascaded, two-fluid, rotary Rankine cycle engine through the use of regenerative heat exchangers in at least one of the two power cycles.

Another object of the invention is to provide a cascaded, two-fluid, rotary Rankine cycle engine which is simple in construction and economical to build due to the elimination of pumps, valves, and elaborate fluid and lubricant isolation seal systems.

Another object of the invention is to provide a cascaded, two-fluid, rotary Rankine cycle engine capable of operating with a high-temperature power fluid which is solid at ambient temperature.

A further object of the invention is to provide a cascaded, two-fluid, rotary Rankine cycle engine which does not require positive isolation of the two power fluids because of means provided for continuously separating any adventitious mixing which occurs.

These and other objects of the invention and the features and details of the construction and operation thereof are hereinafter set forth and described with references to the accompanying drawings in which.

DETAILED DESCRIPTION OF THE INVENTION

Figure 1:
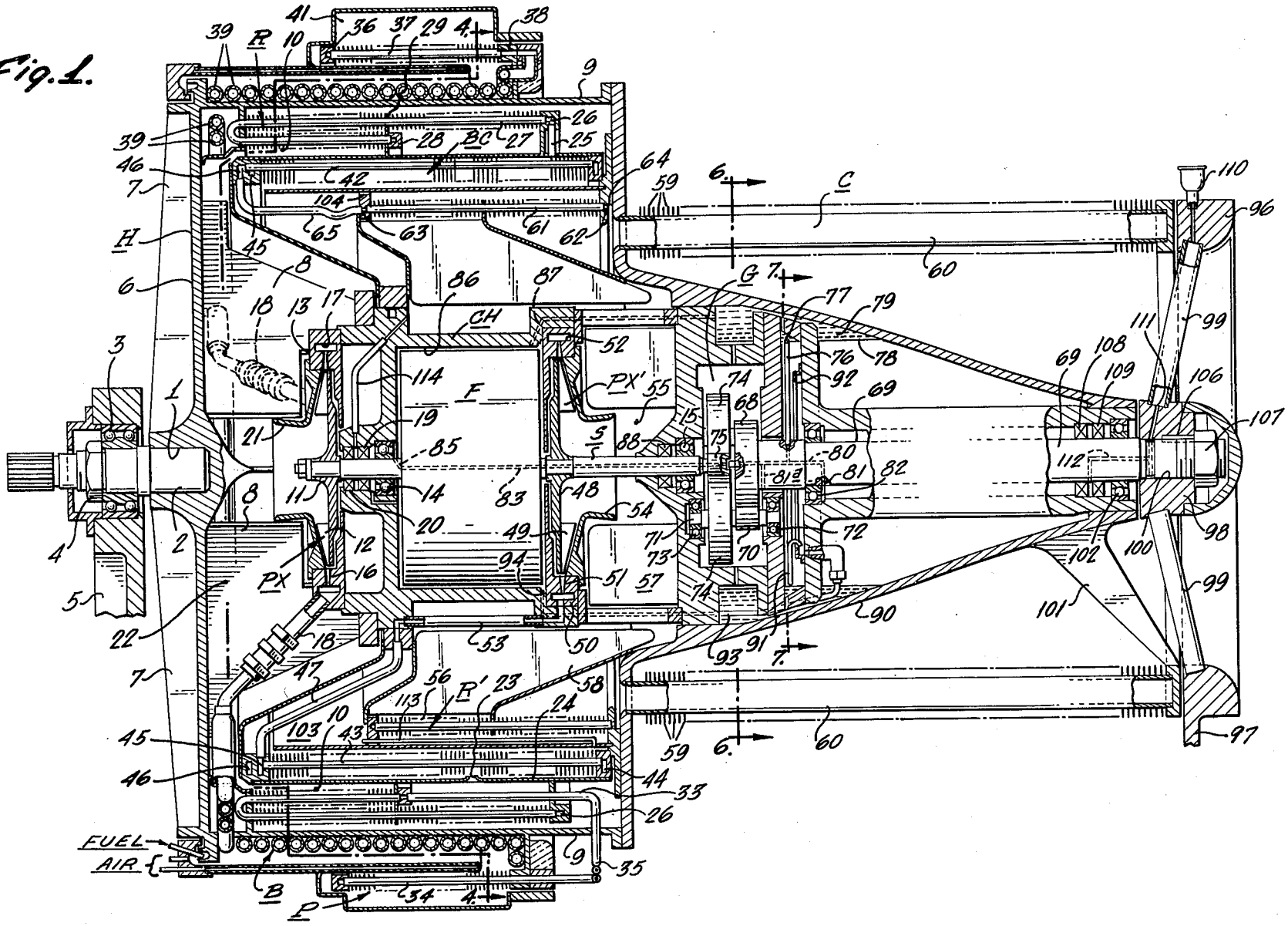
FIG. 1 is a typical sectional side elevation.

One embodiment of a cascaded, two-fluid, rotary Rankine cycle engine embodying the present invention is shown in the drawings and comprises a rotary housing H containing an annular boiler for the high boiling power fluid B, an expander for the high boiling power fluid PX, an annular high boiling power fluid regenerator R, and an annular high boiling power fluid condenser BC. The annular high boiling power fluid condenser BC is also the boiler for the low boiling power fluid. The rotary housing H also contains a low boiling power fluid expander PX', an annular low boiling power fluid regenerator R', and a coaxial central hub structure CH. A condenser C for condensing the low boiling power fluid is mounted coaxially at one side of the housing H for rotation therewith as a unit. The central hub structure CH comprises a coaxial high speed shaft S upon which are mounted the high boiling power fluid expander PX, the low boiling power fluid expander PX', a flywheel F, and means driven by the expanders and connected to the rotary housing H to rotationally drive the latter at a predetermined speed, as hereinafter set forth and described.

In the embodiment of the invention shown in the drawings, the rotary housing H is constructed and operable, for example, substantially as shown and described in U.S. Pat. No. 3,613,368, issued Oct. 19, 1971, and U.S. Pat. No. 3,850,147, issued Nov. 26, 1974. The condenser C is constructed and operable substantially as shown and described in U.S. Pat. No. 3,866,668, issued Feb. 18, 1975, and U.S. Pat. No. 3,773,106, issued Nov. 20, 1973. The central hub structure CH is constructed and operable substantially as shown and described in U.S. Pat. No. 3,744,246, issued July 10, 1973, and U.S. Pat. No. 3,769,796, issued Nov. 6, 1973. The regenerators R and R' are constructed and operable substantially as shown and described in copending application Ser. No. 637,685 filed Dec. 4, 1975.

The rotary housing H has a central bore 1 extending axially and mounted coaxially in the outer end thereof is a shaft 2 rotatably journaled in a bearing 3 which is secured on the shaft 2 with a nut 4. The bearing 3 is mounted in a fixed standard support, or frame 5. The rotary housing H and boiler B comprise a sidewall 6 provided with strengthening gussets 7 and 8. At the outer radial end of sidewall 6 there extends a cylindrical wall portion 9.

In the embodiment of the invention illustrated, the construction and operation of the rotary boiler B, the surrounding combustor and the boiler-liquid pre-heater P, are identical to the boiler combustor and pre-heater shown and described in U.S. Pat. No. 3,850,147, issued Nov. 26, 1974, to which reference may be had and description thereof need not be repeated.

The boiler B is mounted on the outer surface of cylindrical wall surface 9 of the rotary housing H and this wall portion is spaced radially outward from the housing axis to provide an annular chamber 10 within the housing H in which is mounted the high boiling power fluid regenerator R. The construction and operation of which are identical to the regenerator shown and described in the aforesaid application Ser. No. 637,685, filed Dec. 4, 1975. The rotary housing H and high boiling power fluid boiler B are adapted to be driven about the axis at a predetermined speed of rotation calculated to create the centrifugal force necessary to maintain the selected boiler liquid therein uniformly at the same depth circumferentially thereabout with a liquid/vapor interface, indicated at $x$ in FIGS. 2 and 3, that is highly stable and essentially cylindrical and concentric with the axis of rotation with the boiler. The inventory of high boiling power fluid boiler liquid with which the boiler is charged is predetermined to insure that the high boiling power fluid boiler B is about one half full, as shown, at full power output of the boiler and at least partially filled at minimum power. Essentially, the liquid/vapor interface $x$ is disposed at a predetermined radius from the rotation axis of the boiler to provide high boiling heat fluxes in excess of those obtainable at ambient gravity.

The high pressure vapor generated in the high boiling power fluid boiler B is discharged to an internal expander such as PX mounted coaxially within the rotary housing H. The high boiling power fluid expander PX shown is of the single stage type comprising a rotor 11 having a series of radial extending turbine blades 12. The turbine rotor 11 is mounted within an annular recess 13 provided in the housing structure and is mounted for coaxial rotation independently of the housing H and boiler B on a coaxial shaft S that is rotationally mounted in bearings 14 and 15 and an annular series of nozzles 16 is provided in the housing circumferentially adjacent the turbine rotor 11 and in confronting relationship to the blades 12 thereof. An annular high pressure vapor manifold 17 is provided in the housing structure and leads to the nozzles 16.

High boiling power fluid high pressure vapor is supplied from the boiler B to the manifold 17 by a plurality of radial extending vapor tubes 18 arranged in equally spaced relation circumferentially of the axis to insure rotational balance in the unit. The high pressure vapor is discharged from the manifold 17 through nozzles 16 and impinges upon the blades 12 to drive the turbine rotor 11 and its shaft S at the desired speed of rotation. Seals 19 and 20 are provided on the shaft S inwardly adjacent the turbine rotor 11 to minimize migration of the high boiling power fluid from the turbine along said shaft S. A diffuser 21 is mounted coaxially in the housing to receive the high boiling power fluid exhaust vapor from the expander, such as turbine PX, and the exhaust vapor entering the diffuser 21 is discharged into an exhaust chamber 22 in the rotary housing H from which it passes radially to the regenerator chamber 10. Gussets 8 in the exhaust chamber 22 are constructed so as to also serve as baffles which constrain the exhaust vapor to rotate with the engine housing. To thermally insulate the high boiling power fluid high pressure vapor tubes 18 from the lower temperature of the exhaust vapor in the exhaust chamber 22, the vapor tubes 18 are wrapped with suitable insulating material. High boiling power fluid exhaust vapor from the expander PX entering the chamber 22 passes through the regenerator R, hereinafter described, and then flows inwardly through slots 23 in the cylindrical partition 24 to the high boiling power fluid condenser BC, where it is condensed and the condensate returned to the boiler B through said regenerator R and preheater P as later set forth. In the illustrated embodiment of the invention, the condenser BC serves as both the condenser for the high boiling power fluid expanded vapor and the boiler for the low boiling power fluid.

The construction and operation of the tubular regenerator are described in application Ser. No. 637,685, filed Dec. 4, 1975, to which reference may be made and need not be repeated here.

High boiling power fluid condensate from condenser BC collecting on cylindrical partition 24 is conducted radially outward through condensate tubes 25 to manifold ring 26. Trombone shaped regenerator tubes 27 interconnect manifold rings 26 and 28. The regenerator tubes 27 have annular fins thereon arranged circumferentially in equally space relation within the regenerator chamber 10 of the rotary housing H. In the embodiment shown in the drawings, the regenerator is a three pass countercrossflow heat exchanger. The annular partition 29 causes the expanded high boiling power fluid vapor in chamber 10 to flow radially outward over the first two passes of the regenerator. The vapor then flows axially around annular partition 29, radially inward over the third section of regenerator R, and then through slots 23 in cylindrical partition 24.

Tubes 27 are filled with a plurality of small elements of high thermal conductivity such as, for example, spheres or balls or other geometrical shapes of highly conductive material. Preferably said elements and the heat exchange tubes are sintered to bond them to one another and to the tubes to provide good heat transfer.

Secured externally on each of the inner and outer portions of the regenerator tubes 27 is an array of a plurality of radially disposed closely spaced annular fins 30, 31, and 32. A small radial space is provided between fins 30 and 31 to thermally isolate the two sets of fins from one another. The axial spacing of the regenerator fins 30, 31 and 32 on the regenerator tubes 27 is made as small as possible so as to provide a high laminar-flow convective heat transfer coefficient for the vapor while still providing an acceptable pressure drop across the regenerator.

The high boiling power fluid condensate which collects on cylindrical partition 24 flows through condensate tubes 25 to the manifold ring 26. The condensate tubes 25 not only travel radially outward as shown in the figure but also spiral through an angle of about 270° (not shown) before entering manifold ring 26. The purpose of the spiral is to prevent high boiling power fluid liquid from draining from the regenerator tubes 27 back through tubes 25 to condenser chamber BC when the engine is stopped. Likewise tubes 33 which conduct high boiling power fluid liquid from manifold ring 28 to heat exchanger tubes 34 in the pre-heater P are provided with a tube portion 35 which conducts the liquid not only radially outward but also spirally outward through an angle of at least 270° (not shown).

The pre-heater heat exchange tubes 34 supply liquid to the pre-heater manifold ring 36. Liquid in the pre-heater manifold ring 36 is conducted through the balance of the pre-heater heat exchange tubes 37 (which are filled with balls as shown) to pre-heater manifold ring 38 which in turn supplies the pre-heated liquid to boiler tubes 39. As previously described in U.S. Pat. No. 3,850,147, issued Nov. 26, 1974, the spacing of the pre-heater fins 40 is determined with relation to the rotational speed at which the housing-condenser unit is driven and the kinematic velocity of the combustion gases to have a Taylor Number operable at the inner to outer radii ratio of said fins 40 to pump the combustion gases by viscosity shear forces spirally outward between fins 40 into the exhaust gas plenum chamber 41. Such shear force pumping is quiet, efficient, and also provides a high gas side heat transfer coefficient in the pre-heater P. Pre-heater tubes 37 are filled with a plurality of small high thermal conductivity elements preferably sintered to bond them to one another and to the tubes to provide good heat transfer from the tubes to the liquid condensate passing through said pre-heater tubes.

The annular heat exchanger BC serves as the condenser for the high boiling fluid and the boiler for the low boiling power fluid. The heat exchanger BC comprises an annular series of a plurality of axially extending heat exchange tubes 42 and 43 arranged circumferentially in circumscribing relation within the rotary housing H. Tubes 42 join manifold ring chambers 44 and 46. Tubes 43 which are located radially inward of tubes 42 join manifold ring chambers 44 and 45. Low boiling power fluid condensate delivered to manifold ring 46 flows through tubes 42 to manifold ring 44 and then through tubes 43 to manifold ring 45. Tubes 42 are filled with a plurality of small high thermal conductivity elements preferably sintered to bond them to one another and to the tubes to provide good heat transfer. Boiler-condenser BC rotates with rotary housing H about its axis at predetermined speed such that the resulting centrifugal force maintains the boiler liquid therein uniformly at the same depth circumferentially with a liquid/vapor interface indicated at Y that is highly stable and essentially cylindrical and concentric with the axis of rotation of the boiler. The inventory of low boiling power fluid boiler liquid with which the boiler is charged is predetermined to insure that the boiler BC is about half full, as shown, at full power output of the boiler and at least partially filled at minimum power. Essentially, the liquid/vapor interface Y is disposed at a predetermined radius from the rotation axis of the boiler to provide high boiling heat fluxes in excess of those obtainable at ambient gravity.

The low boiling power fluid high pressure vapor generated in the boiler BC is discharged to an internal expander PX', mounted coaxially within the rotary housing H. The expander, PX', shown, is of the single stage type comprising a rotor 48 having a series of radially extending turbine blades 49. The turbine rotor 48 is mounted within a nozzle ring 50 located in the housing structure and is mounted for coaxial rotation with turbine PX and flywheel F independently of the housing H on a coaxial shaft S that is rotationally mounted in bearings 14 and 15. An annular series of nozzles 51 are provided in the nozzle ring 50 circumferentially adjacent to the turbine rotor 48 and in confronting relation to the blades 49 thereof. An annular low boiling power fluid high pressure vapor manifold 52 is provided in the nozzle ring 50 and leads to the nozzles 51.

Low boiling power fluid high pressure vapor is supplied from the boiler BC to the manifold 52 by a plurality of vapor tubes 47 and connecting tubes 53 arranged in equally spaced relation circumferentially of the axis to insure rotational balance in the unit. The low boiling power fluid high pressure vapor is discharged from the manifold 52 through the nozzles 51 and impinges upon the blades 49 to drive the turbine rotor 48 and its shaft S at the desired speed of rotation.

A diffuser 54 is mounted coaxially in the housing to receive the low boiling power fluid exhaust vapor from the expander, such as turbine PX', and the exhaust vapor entering the diffuser 54 is discharged into an exhaust chamber 55 in the rotary housing H from which it passes radially to a second regenerator chamber 56. Baffles 57 and 58 in the exhaust chamber 55 constrain the exhaust vapor to rotate with the engine.

Low boiling power fluid exhaust vapor from the turbine PX' entering the chamber 56 passes through the regenerator R', hereinafter described, and then flows axially to condenser C, where it is condensed and the condensate returned to the boiler BC through said regenerator R' as later set forth. In the illustrated embodiment of the invention, the condenser C comprises a coaxial array of radially disposed annular fins 59 having a plurality of heat exchange tubes 60 extending longitudinally therethrough, and is constructed and operable as shown and described in U.S. Pat. No. 3,866,668, issued Feb. 18, 1975. As shown in said U.S. Pat. No. 3,866,668, the axial spacing or distance between the adjacent fins 59 and the ratio of inner radii to outer radii thereof is important and must be determined with relation to both the rotational speed at which the unit is designed to be driven and the kinematic viscosity of the cooling fluid passing between the fins to provide a Taylor Number that is operable at the fin radii ratio to utilize the viscous properties of the cooling fluid and the shear forces exerted thereon by the rotating fins 59 to convey and accelerate the cooling fluid spirally outward between said fins. For optimum results, the condenser has a Taylor Number in the range of 5 to 10, preferably about 6, and the inner to outer radii ratio of the fins 59 is in the ratio of about 0.70 to 0.85, preferably about 0.77. Fin radii ratios greater than 0.85 provide lower fin areas and lower power consumption for the same heat exchanger capacity but usually are unable to accommodate tubes of sufficient diameter to provide for suitable fluid flow through the tubes without excessive pressure drop.

In the embodiment of the invention shown in the drawings, the regenerator R' comprises a concentric array of circumferentially equally spaced heat exchanger tubes 61. Heat exchanger tubes 61 connect manifold rings 62 and 63. Condensate liquid from condenser tubes 60 collects in groove 64 and flows radially outward to manifold ring 62. The liquid then flows axially through heat exchanger tubes 61 to manifold ring 63 and is delivered by plurality of circumferentially equally spaced tubes 65 to boiler manifold ring 46. Tubes 61 are filled with a plurality of small elements of high thermal conductivity which preferably are sintered to bond them to one another and to the tubes to provide good heat transfer. The axial spacing of regenerator fins 66 and 67 on tubes 61 is made as small as possible to provide a high laminar-flow convective heat transfer coefficient for the vapor while still providing an acceptable pressure drop across the regenerator.

The gear assembly and lubrication system G is a sub-assembly of the coaxial central hub structure CH. The purpose of the gear system is to mechanically couple the rotary housing-condenser unit to the internal expanders driving member through an internal fixed-ratio gear train so that the housing-condenser unit is rotationally driven at a constant ratio to the speed of the expanders. The advantage of this arrangement is that the proportion of the total power generated required to rotationally drive the housing-condenser unit is automatically split off from the total power developed by the engine and the balance of the power is applied directly to the external load on the engine. A second advantage is that the high-speed seal on the drive shaft of a conventional engine is replaced by a low-speed shaft seal which results in reduced engine power losses. The construction and operation of such an internal occluded fixed-ratio gear train system is described in U.S. Pat. No. 3,769,796. The arrangement shown in FIG. 1, and in more detail in FIGS. 6 and 8, uses a variation of the gear arrangement described in the aforesaid patent. Still other internal occluded fixed-ratio gear train arrangements are possible.

Figure 6:
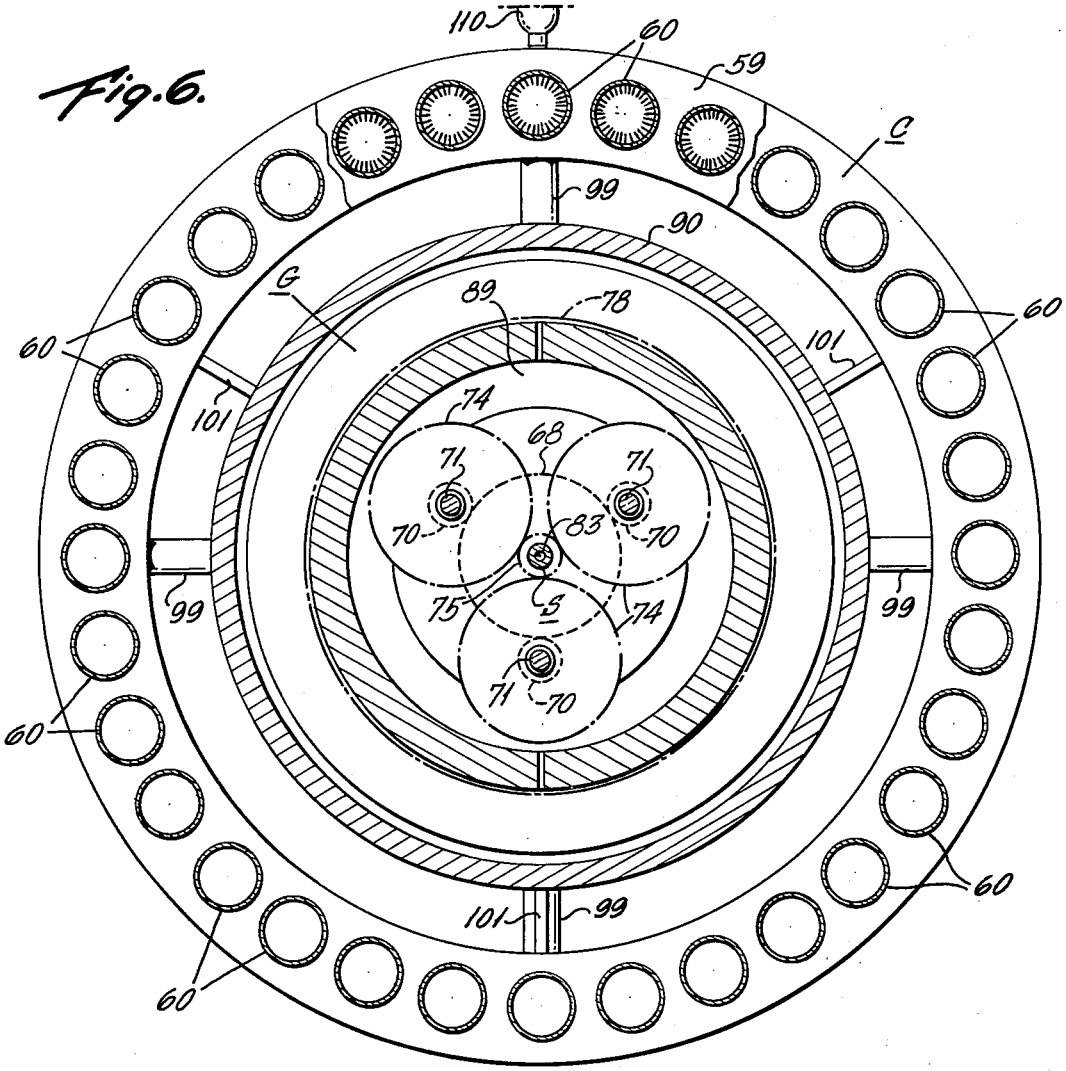
FIG. 6 is an enlarged transverse sectional view taken along line 6—6 of FIG. 1 showing details of the gear train.
Figure 8:
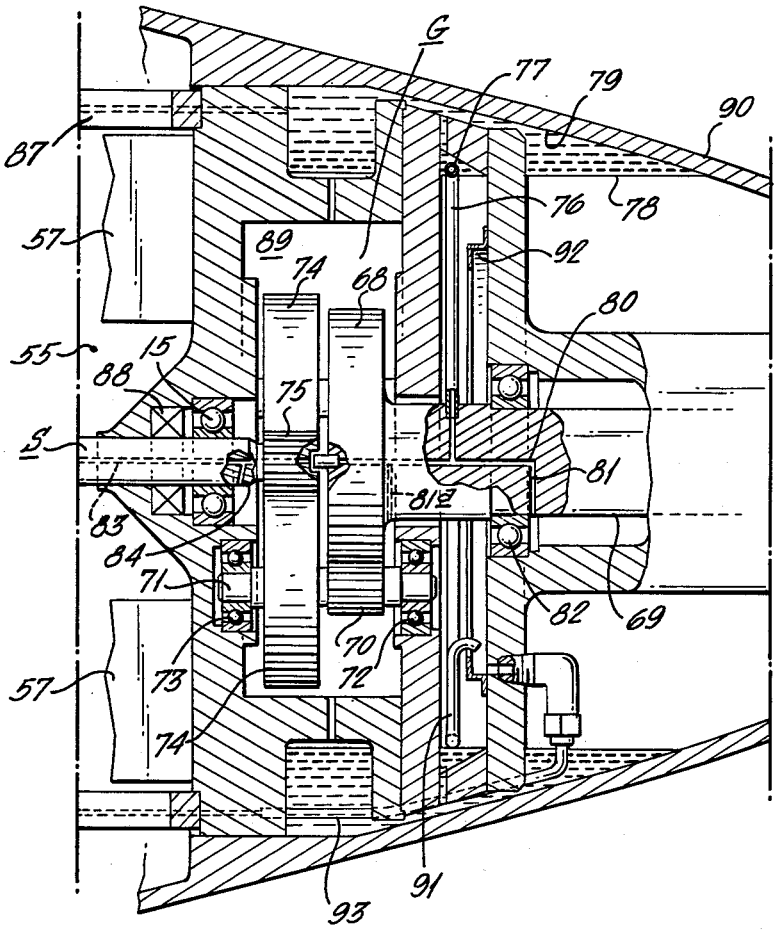
FIG. 8 is an enlarged fragmentary sectional view showing the gear train and lubrication system shown in FIG. 1.

In the embodiment of the invention shown in FIGS. 1, 6 and 8, the epicyclic gear train comprises a spur gear 68 fixedly mounted on the non-rotating torque shaft 69. The stationary shaft 69 functions as a torque anchor and opposes the reaction torque generated by the engine. Meshed with the spur gear 68 are three spur gears 70. Each of the spur gears 70 is fixedly mounted on stub shafts 71 which rotate in bearings 72 and 73. Spur gears 74 also fixedly mounted on stub shafts 71 mesh with spur gear 75 on high-speed shaft S. The foregoing occluded epicyclic gear system provides a two-stage speed reduction between the high-speed turbine expanders PX and PX' and the housing-condenser unit. Power from the engine is delivered through shaft 2.

Figure 7:
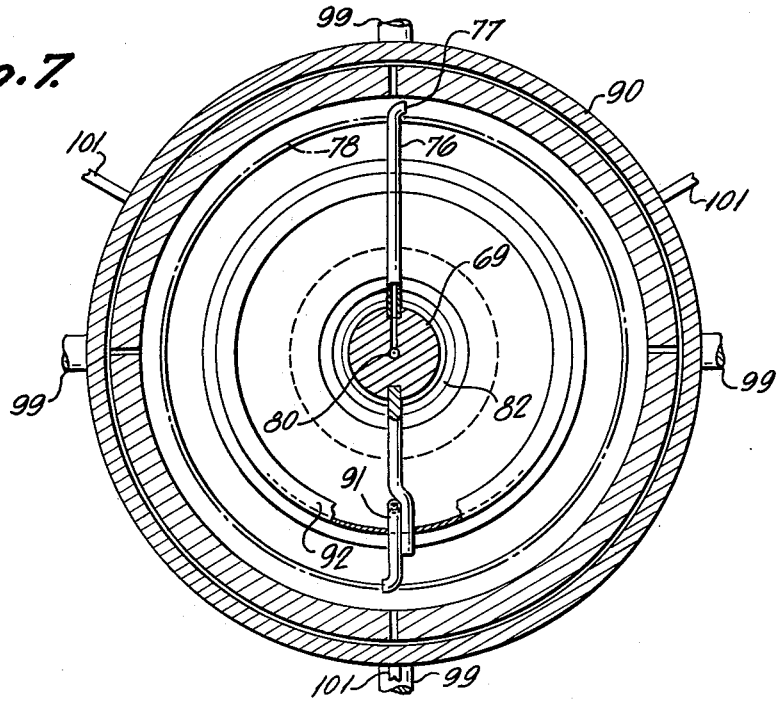
FIG. 7 is an enlarged transverse sectional view taken along line 7-7 of FIG. 1 showing details of the lubrication system.

The various moving parts of the engine are lubricating by a force feed system utilizing a Pitot type pump shown in detail in FIGS. 7 and 8. The Pitot pump comprises a radial tube 76 attached to torque shaft 69 and having at its outer end an L-shaped tip 77, the inlet end of which is immersed in an annular bath of lubricant 78 in the sump 79. The inner end of the radial passage 76 is connected to a coaxial passage 80 formed in the torque shaft 69 and extending a short distance into the adjacent end portion of torque shaft 69 where it connects with a radial passage 81 that opens adjacent the bearing 82 and a radial passage 81*a* that opens adjacent bearings 72. A coaxial passage 83 extends through the spur gear 75 and high-speed shaft S where it connects with radial passages 84 that open adjacent the bearing 15 and radial passage 85 that opens adjacent the bearing 14. Excess oil draining from bearing 14 and collecting in the outer periphery of flywheel chamber 86 drains back to oil sump 79 through tube 87. High-speed seal 88, like high-speed seals 19 and 20, is a lightly contacting type that causes only a slight frictional drag on high-speed shaft S. Consequently, some low boiling power fluid vapor from exhaust chamber 55 is able to migrate past seal 88 into the gear and lubrication chamber 89 where it condenses and dissolves in the lubricant in sump 79. The lubricant sump 79 is cooled by the incoming condenser air passing over lubricant sump wall 90. The low boiling power fluid condensing in the lubricant sump 79 will increase the radial depth of the bath 78 so that it is intercepted by Pitot pump 91 which skims off the excess lubricant mixture and transfers it to collector ring 92. The mixture collecting in ring 92 flows through tube 93 to recess 94 adjacent nozzle ring 50 in flywheel chamber 86. Heat from the nozzle ring distills the low boiling power fluid from the lubricant mixture. The lubricant liquid overflows onto the outer periphery of flywheel chamber 86 and drains back to oil sump 79 through tube 87. The low boiling power fluid vapor flows around turbine expander PX' into low boiling power fluid chamber 55. This lubricant bath level control system is similar to that described in U.S. Pat. No. 3,863,454. The lubrication system is similar to that described in U.S. Pat. No. 3,744,246. Additional details of construction and operation are described in the aforesaid U.S. patents.

The condenser inlet bell ring 96 mounted in frame 97 supports hub 98 with a plurality of spokes 99. Hub 98 has a central bore 100 extending axially in which torque shaft 69 is coaxially and non-rotatably mounted. The condenser end of the rotary housing-condenser unit attaches to the lubricant sump wall 90 with struts 101 and is rotatably journaled on bearing 102 which is mounted on torque shaft 69.

Shaft 69 is keyed to hub 98 with key 106 and locked to hub 98 with nut 107. Seals 108 and 109 isolate the power fluid and lubricant in the engine from the ambient atmosphere. The space between the seals is filled with lubricant oil from oil reservoir 110 which delivers oil through passageways 111 and 112. The position of oil reservoir 110 insures an oil pressure head on the space between seals 108 and 109. This pressure head prevents air leakage into the engine.

Figure 2:
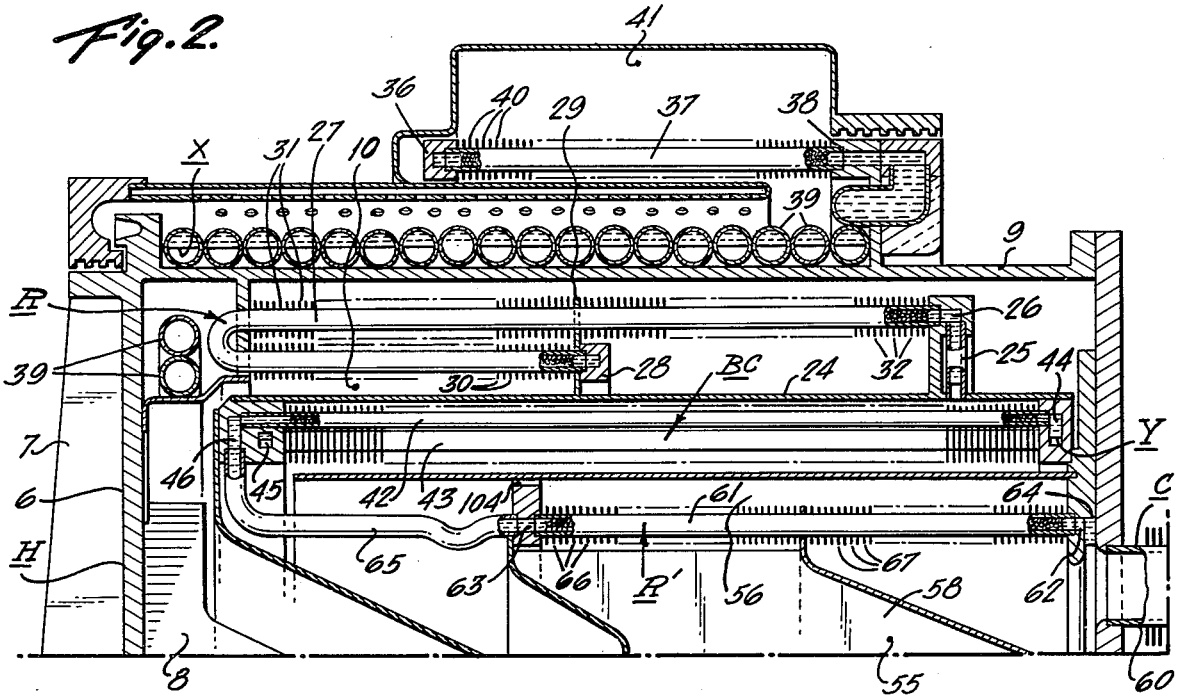
FIG. 2 is a fragmentary enlarged section of the upper portion of FIG. 1 showing the burner, boiler, both regenerators and boiler condenser.
Figure 3:
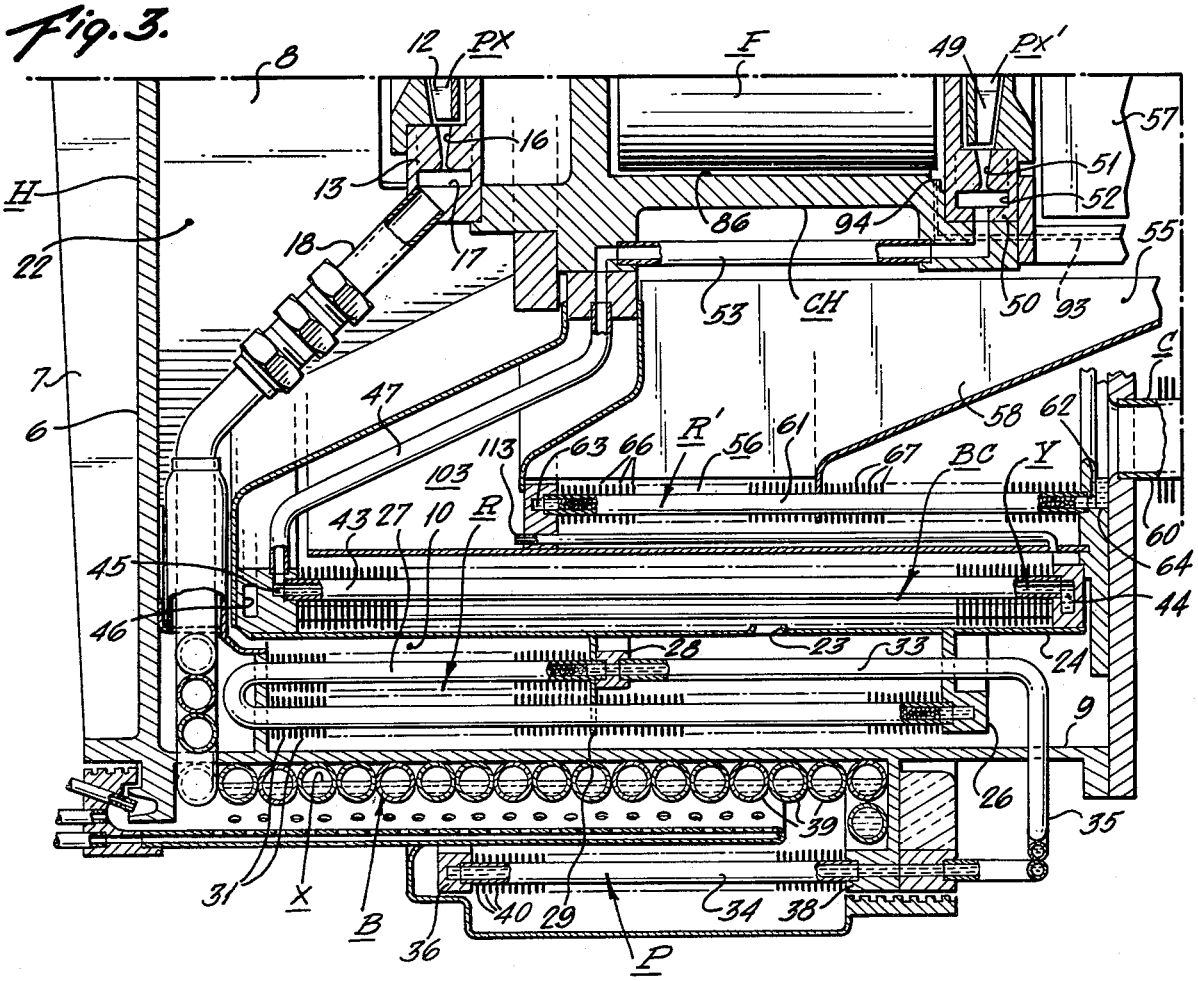
FIG. 3 is a fragmentary enlarged section of the lower portion of FIG. 1 similar to FIG. 2 but showing other details.

To get high engine efficiency, it is necessary to use cascaded high boiling and low boiling fluids in the manner described in this invention. However, high boiling fluids with high thermal stability tend to be complex molecules so that regeneration of the high boiling fluid is preferred in order to obtain good thermal efficiency. The regenerator R shown in FIGS. 1 to 3, located between the high boiling power fluid boiler B and the boiler-condenser BC, is essentially a three-stage countercrossflow heat exchanger of inverted order. Although other arrangements could be used, the one shown in FIGS. 1 to 3 makes maximum use of the space available. Since the vapor leaving the second stage of a two-stage crossflow heat exchanger tends to be uniform in temperature across the length of the heat exchanger, there is essentially no thermal mixing loss in conducting the vapor horizontally to the third stage as shown in FIGS. 1 to 3. The low-boiling fluid regenerator R' is less important in this engine because low-boiling fluids are generally simpler molecules which tend to have good thermodynamic efficiency without regeneration. However, a regenerator is shown in FIGS. 1 to 3 since improved efficiency does result from its use and since only a relatively small regenerator is required to improve the efficiency.

No attempt is made to completely isolate the two power fluids from one another. The paths of the two fluids is such that mixing is minimized. Both fluid cycles are selected to condense at the same pressure so that the migration of the fluid between the two cycles is minimized. Any low boiling fluid migrating into the high boiling fluid will collect in the boiler-condenser chamber 103 as a non-condensible. Breathing holes 104 in this chamber connect to low boiling vapor space 55 and second regenerator chamber 56. Thus, the low-boiling power fluid appearing as a non-condensible in the boiler-condenser vapor space will be purged back to a low-boiling power fluid chamber. Purge tubes 113 conduct the non-condensing, low-boiling power fluid from the right-hand end of the boiler-condenser chamber 103 to the left-hand end. This gives the condensing, high-boiling vapor access to all of tube fins of the boiler-condenser BC.

Figures 4, 5:
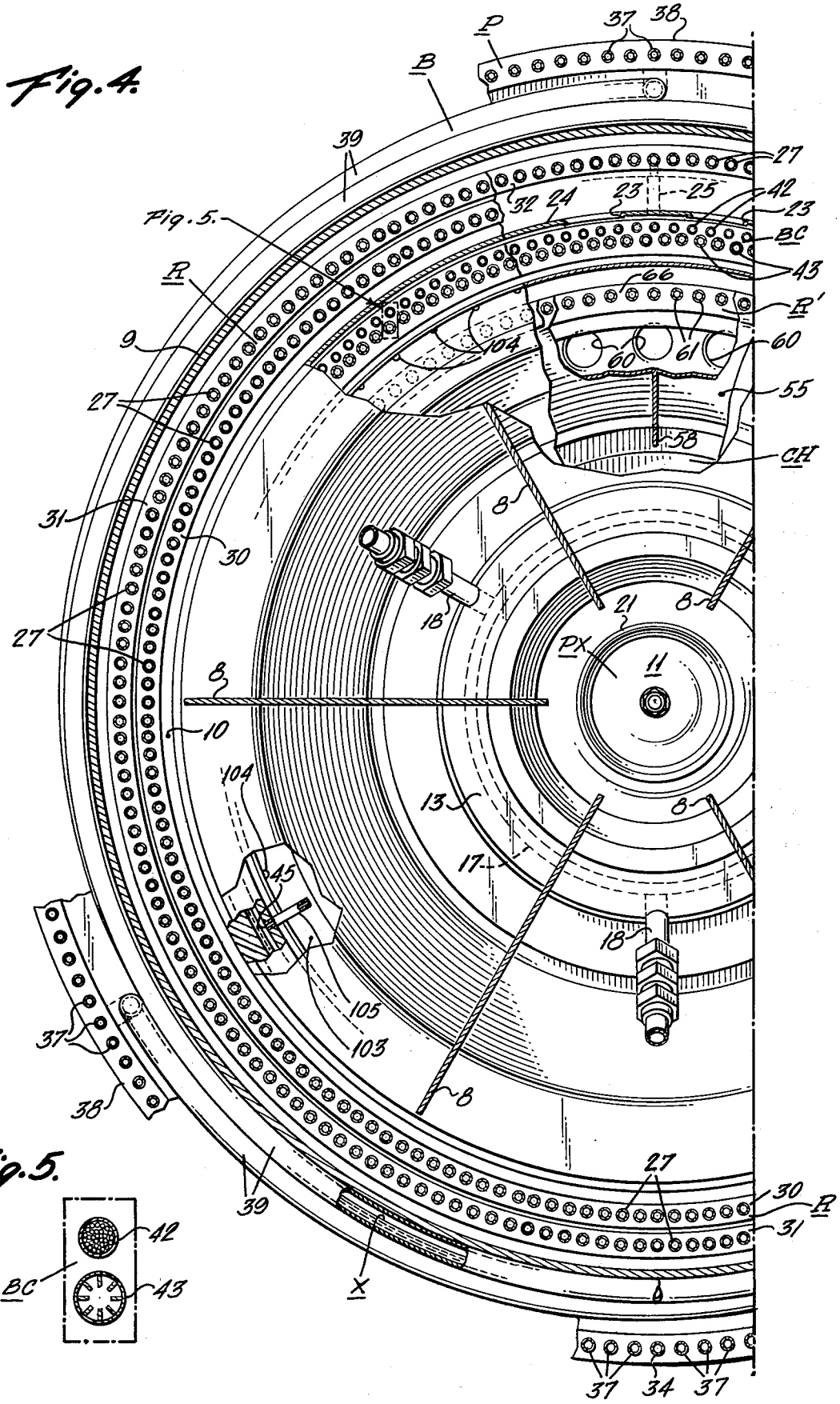
FIG. 4 is an enlarged transverse sectional view taken along line 4—4 of FIG. 1.
FIG. 5 is an enlarged detail within the dotted box portion of FIG. 4.

High-boiling power fluid which migrates into the low-boiling power fluid will appear as a non-vaporizing residue in the low-boiling power fluid boiler BC. This residue along with some of the low-boiling power fluid is purged, as shown in FIG. 4, from annular ring 45, where it concentrates, with a capillary purge line 105 which dumps the mixture into chamber 103. In chamber 103 the low-boiling portion of the mixture vaporizes and follows the path previously described. The high-boiling portion of the purged mixture collects with the high-boiling power fluid condensate on cylindrical partition 24. The annular space between lightly contacting seals 19 and 20 is connected to low boiling power fluid vapor space 55 by tube 114. This arrangement serves to intercept any high boiling power fluid vapor which migrates past seal 20 and prevent its migration past seal 19 into the lubrication system.

The radial location of all of the heat exchangers must be chosen so as to provide the required liquid head for each heat exchanger. These liquid heads are developed according to the liquid leg heights between the heat exchangers. In order that variation in the centrifugal force operating on the liquid heads due to variations in engine speed have only a minor effect on the radial dimensions of the engine, it is desirable that the pair of power fluids used be relatively high boiling. In addition to the high boiling point requirement, careful matching of the power fluids is necessary for good turbine efficiency depending upon the thermodynamic power cycles selected and the fluid flow rates required to provide the desired engine power. The optimum turbine design for the high-boiling power fluid and the low-boiling power fluid should result in similar turbine speeds. A small accommodation can be made in turbine speed without much sacrifice in turbine efficiency by changing the turbine diameter. However, if the optimum turbine speeds are not close, engine efficiency will be sacrificed.

Thermally stable power fluids which are otherwise desirable for use as the high boiling power fluid in a cascaded two-fluid Rankine cycle engine are often solids at ambient temperatures. A unique feature of this rotary engine is its ability to utilize such fluids. The engine design is such that when rotation stops the low-boiling, low-melting power fluid drains from the upper portions of the regenerator tubes 61 and boiler tubes 43 through manifold ring 62 to groove 64, overflows into the vapor side of regenerator R′, and drains through breathing holes 104 and passageway 23 into the vapor side of the high-boiling power fluid regenerator chamber 10. Thus, when rotation occurs during engine start up, the low-boiling power fluid is located in chamber 10 just radially inward of the combustor/boiler roof 9. While the high-boiling power fluid is melting, heat from the boiler roof causes the low-boiling power fluid to reflux in the high-boiling power fluid vapor passageways thereby pre-heating all of these metal parts. With a conventional Rankine cycle engine which has valves and mechanical pumps, operation with a power fluid which is solid at ambient temperature is very difficult if not impossible. With the engine described in this invention, such operation is a simple matter. Before the high-boiling, high-melting power fluid can reach the cold internal components of this engine at start-up, the parts have been thoroughly pre-heated by the refluxing low-boiling power fluid. As the high-boiling power fluid successively fills exhaust chamber 22, regenerator chamber 10 and most of boiler-condenser chamber 103, the lower boiling power fluid is completely vaporized and displaced back through breathing holes 104 to vapor space 55 where it starts circulating in its own power cycle.

An important feature of rotary Rankine cycle engines is the simplified liquid pumping that occurs in the tubing leading to the boiler providing the liquid leg. The liquid is automatically supplied to the boiler as required, thereby eliminating the necessity for a control system to match the boiler feed pump rate to the fuel rate as in a stationary boiler. This simple, efficient and automatic method of pumping is vitally important in a cascaded two-fluid rotary Rankine cycle engine since the complexity of two pumps and two control systems would be impractical.

It is important for proper operation that the boiler-condenser BC have a greater capacity than is required at all operating conditions. That is, there should always be some low-boiling power fluid vapor present blanketing a portion of the outside of the boiler-consdenser BC heat exchanger surface so that the high-boiling power fluid vapor never, or at least rarely, reaches condenser C. High boiling power fluid vapor which does occasionally reach condenser C is condensed along with the low boiling power fluid and flows through regenerator R′ to boiler-condenser BC where it concentrates as a non-vaporizing residue in annular ring 45. This residue is purged as previously described.

A typical calculated example of a cascaded two-fluid rotary closed Rankine cycle engine embodying the construction shown in FIGS. 1–8 and designed for an output of 50 hp at the turbine shaft S, comprises a boiler B having a liquid level $x$ diameter of 23.3 inches and an axial length sufficient to provide the heat input required to the boiler liquid from the combustion gases. The boiler consists of a plurality of coiled tubes 39 which are 0.5 inch diameter. The pre-heater P comprises 180 heat exchange tubes 34 and 37 each having an axial length of 5 inches and an outside diameter of 0.25 inch equally spaced circumferentially on 26.6 inch diameter centers. Three tubes 34 are empty and 177 tubes 37 are filled with balls to promote heat transfer. The array of annular fins P has an axial length of 5 inches and the fins 40 each have a thickness of 0.031 inch and the spacing between adjacent fins is 0.074 inch. Each of the fins has an inner diameter of 26.1 inches and an outer diameter of 27.1 inches. The three pass countercrossflow regenerator R comprises 200 ball-filled 0.25 inch diameter tubes 27 equally spaced circumferentially on 21.54-inch diameter centers. The two arrays of annular fins 31 and 32 have an axial length of 4.5 inches each and the fins have a thickness of 0.01 inch and the spacing between adjacent fins is 0.01 inch. Each of the fins 31 and 32 has an inner diameter of 21.04 inches and an outer diameter of 22.04 inches. The 200 ball-filled 0.25-inch diameter tubes 27 also pass through a third array of fins 30. This array of annular fins has an axial length of 4.5 inches and the fins each have a thickness of 0.01 inch and the spacing between adjacent fins is 0.01 inch. Each of the fins has an inner diameter of 19.94 inches and an outer diameter of 20.94 inches. The boiler-condenser BC comprises an annular array of fins with two rows of tubes 42 and 43 equally spaced circumferentially. The inner row 43 comprises 180 internally finned tubes 0.25 inch in diameter on 18.4 inch diameter centers. The outer row 42 comprises 180 ball-filled tubes 0.19 inch in diameter on 18.88 inch diameter centers. The array of annular fins has an axial length of 10 inches and fins each have a thickness of 0.01 inch and the space between adjacent fins is 0.02 inch. Each of the fins has an inner diameter of 17.7 inches and an outer diameter of 19.2 inches. The regenerator R′ comprises 128 ball-filled tubes 0.25 inch in diameter. The tubes 61 are equally spaced circumferentially on 6.06 inch diameter centers. Two arrays of annular fins 66 and 67 having an axial length of 3.5 inches each are arranged on the tubes. The fins each have a thickness of 0.01 inch and the spacing between adjacent fins is 0.01 inch. Each of the fins has an inner diameter of 15.56 inches and an outer diameter of 6.55 inches. The condenser C comprises 32 internally finned 1.0 inch diameter tubes 60. The tubes 60 are equally spaced circumferentially on 14.43 inch diameter centers. The array of annular fins as an axial length of 6 inches and the fins 59 each have a thickness of 0.01 inch and the spacing between adjacent fins is 0.03 inch. Each of the fins 59 has an inner diameter of 12.86 inches and an outer diameter of 16 inches. The high boiling power fluid expander has a diameter of 6.1 inches and the low boiling power fluid expander has a diameter of 6.7 inches. The expanders operate at a speed of 26,400 rpm and the boiler-condenser at a speed of 2400 rpm.

Using m-diphenylbenzene as the high boiling power fluid and o-dichlorobenzene as the low boiling power fluid, the specifications of a typical operation of the designed apparatus are as follows.

m-Diphenylbenzene Cycle

Boiler temperature (° F): 800
Boiler pressure (psia): 34
Boiler load (Btu/hr): 410,000
Regenerator load (Btu/hr): 189,000
Condenser temperature (° F): 506
Condenser pressure (psia): 1.4
Condenser load (Btu/hr): 346,000 o-Dichlorobenzene Cycle

Boiler temperature (° F): 450
Boiler pressure (psia): 51
Regenerator load (Btu/hr): 57,000
Condenser temperature (° F): 220
Condenser pressure (psia): 1.4
Condenser load (Btu/hr): 283,000
Rankine cycle efficiency (%): 38

The engine operates at essentially a constant speed of 2400 rpm with power modulation resulting from changes in the torque as the fuel rate and hence the boiler pressures are increased or decreased. In order to provide for rapid engine response to increased demand for power, flywheel F is provided on the turbine shaft S. By allowing for some drop in engine speed below the 2400 rpm design point, power can be supplied from flywheel F for a few seconds while the boiler temperatures rise to their new operating points. The flywheel also has overspeed capabilities for regenerative braking energy storage. The rapid response of the light weight, low thermal inertia, high performance burner/boiler B shown and described in U.S. Pat. No. 3,850,147 is such that a small flywheel is adequate. Flywheel F shown in FIG. 1 is intended for supplemental energy storage and is larger than that required for engine response. The flywheel has a diameter of 7 inches, a length of 4 inches, and a weight of 44 pounds. As the engine is allowed to drop from 2400 to 2000 rpm, the flywheel will provide 200 hp-seconds of energy. The engine design can accommodate speeds as low as 2000 rpm and still provide enough condenser capacity and liquid leg pressure on the boilers and regenerators so as to permit full power operation.

For good engine efficiency, the exhaust combustion gas temperature is brought down with a static, non-rotating recuperator or combustion air pre-heater. Because of the design in FIG. 1 as shown and described in U.S. Pat. No. 3,850,147, which removes heat from the flame before combustion is complete, the combustor temperature can be kept low even with an air pre-heater. This low combustor temperature is desirable since it minimizes the formation of $NO_x$. In the typical calculated design shown in FIG. 1, the air pre-heater load is 39,000 Btu/hr and the exhaust air temperature is 470° F.

For proper operation of the cascaded two-fluid rotary closed Rankine cycle engine, a condenser air flow controller is desirable. The air flow rate through condenser C is throttled so that the flow rate is proportional to the fuel rate and inversely proportional to the difference between a constant and the condenser inlet air temperature. For the typical calculated design described above, the constant is 176 with a design inlet air temperature of 90° F. Throttling the condenser air flow has several important effects. It conserves air pumping power at low engine power levels and/or at low ambient air temperatures. Throttling condenser air flow tends to maintain expander nozzle expansion ratios constant for all operating conditions. Also, throttling condenser air flow insures that the high boiling power fluid vapor is not drawn into the air condenser at low power levels and/or low ambient air temperatures.

What is claimed is:

1. In a closed, rotary Rankine cycle engine having a rotatable annular boiler-combustor system for introducing heat to the engine, an expander system for extracting work and a condenser rotatable with the boiler-combustor system for removing heat from the engine, the improvement of an engine of cascaded Rankine cycles comprising:

1. a rotatable annular boiler containing a first boiler liquid,
2. means to heat the first boiler liquid in the boiler to generate pressure vapor therein,
3. an expander system for extracting work from the pressure vapor,
4. an annular condenser rotatable with the boiler for condensing the exhaust vapor from the expander by heat-exchange, said condenser comprising heat-exchange, tubes for passing the exhaust vapor thereover to heat a second liquid contained in the tubes to generate pressure vapor therein, said second liquid having a lower boiling point than the first boiler liquid,
5. means for returning the vapor condensate to the boiler,
6. a second expander system for extracting work from the pressure vapor generated in the heat-exchange tubes,
7. a rotatable second condenser for condensing the exhaust vapor from the second expander by heat-exchange, and
8. means for returning the vapor condensate from the second condenser to the heat-exchange tubes.

2. The Rankine cycle engine of claim 1 having a first annular regenerator chamber radially inward of the boiler means for discharging exhaust vapor from the first expander and delivering the same to the first regenerator chamber, a first annular regenerator in said first chamber rotatable with the boiler comprising at least one annular series of a plurality of equally circumferentially spaced, axially extending heat-exchange tubes each having thereon a plurality of axially spaced annular fins, the exhaust vapors discharged to said first chamber passing between the fins.

3. The Rankine cycle engine of claim 2 having a second annular regenerator chamber radially inward of the first condenser, means for discharging exhaust vapor from the second expander and delivering the same to the second regenerator chamber, and a second annular regenerator in said second chamber rotatable with the boiler comprising at least one annular series of a plurality of equally circumferentially spaced, axially extending heat-exchange tubes each having thereon a plurality of axially spaced annular fins, the exhaust vapors discharged to said second chamber passing between the fins.

4. The Rankine cycle engine of claim 3 wherein the annular condenser is a condenser-boiler comprising a plurality of axially extending heat-exchange tubes each having thereon a plurality of axially spaced annular fins.

5. The Rankine cycle engine of claim 1 having means for separating any low boiling liquid which mixes with the first boiler liquid and returning it to a chamber containing vapor of the low boiling liquid; and means for separating any first boiler liquid which mixes with the low boiling liquid and returning it to a chamber containing condensate of the first boiler liquid.

6. The Rankine cycle engine of claim 5 having means for pre-heating engine components contactable by vapor of the first boiler liquid during operation by refluxing the low boiling liquid in vapor passageways for the first boiler liquid and returning vapor of the low boiling liquid to its own vapor passageways when displaced by vapor of the first boiler liquid.

7. The Rankine cycle engine of claim 1 having an occluded fixed ratio gear train mounted coaxially with the annular boiler for coupling the rotatable second condenser to said expanders.

8. The Rankine cycle engine of claim 7 wherein each expander includes a common, coaxially rotatable driving member actuated by the expanders and said gear train is connected to the common driving member for said expanders.

9. The Rankine cycle engine of claim 8 having means for lubricating moving parts of the engine.

10. The Rankine cycle engine of claim 1 wherein said expanders are coaxially mounted for rotation on a common driving member actuated by the expanders, said engine having a flywheel rotatably mounted on said common driving member.

11. The Rankine cycle engine of claim 4 having means for separating any low boiling liquid which mixes with the first boiler liquid and returning it to a chamber containing vapor of the low boiling liquid; and means for separating any first boiler liquid which mixes with the low boiling liquid and returning it to a chamber containing condensate of the first boiler liquid and means for pre-heating engine components contactable by vapor of the first boiler liquid during operation by refluxing the low boiling liquid in vapor passageways for the first boiler liquid and returning vapor of the low boiling liquid to its own vapor passageways when displaced by vapor of the first boiler liquid.

12. The Rankine cycle engine of claim 11 wherein said expanders are coaxially mounted for rotation on a common driving member actuated by the expanders, said engine having (a) an occluded fixed ratio gear train coaxial with the expanders and connected to the common driving member for coupling the expanders to the rotatable second condenser; (b) means for lubricating moving parts of the engine and (c) a flywheel rotatably mounted on the common driving member.

13. A cascaded, two-fluid, rotary, closed Rankine cycle engine comprising, in combination:

a cylindrical housing rotatable about its axis, a coaxial annular boiler associated with said housing and rotatable therewith, said housing and boiler adapted to be rotated at a first predetermined speed to maintain in the boiler an annular body of a first boiler liquid having a liquid/vapor interface spaced a predetermined distance radially from said axis, means to rotationally drive the housing and boiler at said first predetermined speed, means to heat the first boiler liquid in the boiler and generate pressure vapor therein, a first expander mounted coaxially within the housing for extracting work from the pressure vapor generated in the boiler and including a coaxial driving member rotatably driven thereby at a second predetermined speed;

a first annular regenerator chamber radially inward of the boiler defined by portions of the housing, means for discharging exhaust vapor from the first expander and delivering the same to the first regenerator chamber, a first annular regenerator in said first chamber rotatable with the housing comprising at least one annular series of a plurality of equally circumferentially spaced axially extending heat-exchange tubes each having thereon a plurality of axially spaced annular fins, the exhaust vapors discharged to said first chamber passing between the fins, an annular condenser-boiler radially inward of said regenerator associated with said housing and rotatable therewith, said condenser-boiler comprising a plurality of axially extending heat-exchange tubes each having thereon a plurality of axially spaced annular fins for passing the exhaust vapor from the first regenerator therebetween to heat a second liquid passing through the tubes to generate a pressure vapor therein having a liquid/vapor interface a predetermined distance radially from the boiler axis, said second liquid having a lower boiling point than the first boiler liquid, means for conducting exhaust vapor after passage through the regenerator to said condenser-boiler and for returning liquid condensate therefrom to the regenerator for passage through the tubes thereof in heat exchange relation with exhaust vapor passed between the fins thereon, means for returning the liquid condensate to the boiler after passage through the regenerator tubes, a second expander, mounted for coaxial rotation within the housing with said first expander, for extracting work from the pressure vapor generated in the heat-exchange tubes of the condenser-boiler, a second annular regenerator chamber radially inward of the condenser-boiler defined by portions of the housing, means for discharging exhaust vapor from the second expander and delivering the same to the second regenerator chamber, a second annular regenerator in said second chamber rotatable with the housing comprising at least one annular series of a plurality of equally circumferentially spaced axially extending heat-exchange tubes each having thereon a plurality of axially spaced annular fins, the exhaust vapors discharged to said second chamber passing between the a second condenser mounted coaxially adjacent said housing and rotatable therewith comprising a plurality of axially spaced fins having heat exchange tubes extending longitudinally therethrough, means for conducting exhaust vapor after passage through the second regenerator to the tubes of said second condenser and for returning liquid condensate of the second liquid therefrom to the second regenerator for passage through the tubes thereof in heat-exchange relation with the exhaust vapor from the second regenerator chamber passed between the fins thereon, and means for returning the second liquid condensate to the tubes of the condenser-boiler after passage through the second regenerator tubes.

14. The Rankine cycle engine of claim 13 wherein each of the heat-exchange tubes of the first regenerator, second regenerator and condenser-boiler are substantially filled with a plurality of small elements of high thermal conductivity.

15. The Rankine cycle engine of claim 13 wherein the means for returning liquid condensate from the condenser-boiler to the first regenerator tubes contains breathing holes for returning any vapor of the low boiling liquid contained in said liquid condensate to the second annular regenerator chamber; and the boiler-condenser has attached to the exit end of the tubes a purge line for returning any first boiler liquid contained in the low boiling liquid to the means for returning liquid condensate from the condenser-boiler to the first regenerator tubes.

16. The Rankine cycle engine of claim 13 having an occluded fixed gear train mounted coaxially within the cylindrical housing and interconnected between the driving member for said expanders and said housing operable to rotationally drive the housing and the boiler about said axis at said first predetermined speed.

17. The Rankine cycle engine of claim 6 wherein the gear train is an epicyclic gear train having means cooperable therewith for opposing the reaction torque generated thereby so that the power output of the expanders is transmitted directly to the cylindrical housing.

18. The Rankine cycle engine of claim 17 having means for lubricating moving parts of the engine.

19. The Rankine cycle engine of claim 18 wherein said means comprise the cylindrical housing including a sump compartment for containing an annular bath of lubricant and the means for opposing the torque is non-rotatable with the housing and includes pump means operable to pump lubricant inwardly from said annular bath to the expander driving member to lubricate the same.

20. The Rankine cycle engine of claim 19 having a flywheel rotatably mounted in said expander driving member within an enclosed, coaxial flywheel chamber, and means for returning lubricant that migrates to said chamber to said sump.

21. The Rankine cycle engine of claim 20 having sump means operable to pump lubricant containing low-boiling liquid from the annular bath to said flywheel chamber.

22. The Rankine cycle engine of claim 21 wherein the means for returning liquid condensate from the condenser-boiler to the first regenerator tubes contains breathing holes for returning any vapor of the low boiling liquid contained in said liquid condensate to the second annular regenerator chamber; and the boiler-condenser has attached to the exit end of the tubes a purge line for returning any first boiler liquid contained in the low boiling liquid to the means for returning liquid condensate from the condenser-boiler to the first regenerator tubes.

23. The Rankine cycle engine of claim 22 wherein each of the heat-exchange tubes of the first regenerator, second regenerator and condenser-boiler are substantially filled with a plurality of small elements of high thermal conductivity.

* * * * *